US006189236B1

(12) United States Patent
Gaines et al.

(10) Patent No.: US 6,189,236 B1
(45) Date of Patent: Feb. 20, 2001

(54) PROCESS FOR DRYING A REACTOR SYSTEM EMPLOYING A FIXED BED ADSORBENT

(75) Inventors: David Mason Gaines, St. Albans; Philip Everett Harrison, Winfield; Roger Brady Painter, Scott Depot, all of WV (US); Bill Jack Garner, Sudbury, MA (US)

(73) Assignee: Union Carbide Chemicals & Plastics Technology Corporation, Danbury, CT (US)

( * ) Notice: Under 35 U.S.C. 154(b), the term of this patent shall be extended for 0 days.

(21) Appl. No.: 09/187,580

(22) Filed: Nov. 5, 1998

(51) Int. Cl.[7] ..... F26B 3/00

(52) U.S. Cl. ..... 34/329; 34/375; 34/443; 526/68; 526/904

(58) Field of Search ..... 34/23, 32, 48, 34/80, 121, 329, 375, 359, 443; 526/68, 67, 70, 901, 904

(56) References Cited

U.S. PATENT DOCUMENTS

| | | | | |
|---|---|---|---|---|
| 3,972,129 | | 8/1976 | Graff | 34/32 |
| 4,182,801 | | 1/1980 | Miserlis et al. | 526/77 |
| 4,484,933 | | 11/1984 | Cohen | 55/25 |
| 5,186,814 | * | 2/1993 | Bedard | 208/46 |
| 5,322,927 | * | 6/1994 | Ramachandran et al. | 528/482 |
| 5,453,471 | * | 9/1995 | Bernier et al. | 526/68 |
| 5,733,510 | * | 3/1998 | Chinh et al. | 422/143 |
| 5,733,988 | * | 3/1998 | Apecetche et al. | 526/74 |
| 6,001,938 | * | 12/1999 | Chinh et al. | 526/68 |

* cited by examiner

*Primary Examiner*—Pamela Wilson
(74) *Attorney, Agent, or Firm*—B L Deppenbrock; R C Brown

(57) ABSTRACT

A method of reducing the purge gas consumption, dry-down time, or both required for start-up and operation of a gas phase fluidized bed reactor system. The method involves contacting a stream of cycle gas having water and/or a polar hydrocarbon with an adsorbing material while the cycle gas is in a closed circulation loop.

15 Claims, 1 Drawing Sheet

SIMPLIFIED FLOW DIAGRAM OF FLUIDIZED BED POLYMERIZATION SYSTEM WITH ADSORPTION TOWER FOR DRYING

FIGURE I. SIMPLIFIED FLOW DIAGRAM OF FLUIDIZED BED POLYMERIZATION SYSTEM WITH ADSORPTION TOWER FOR DRYING
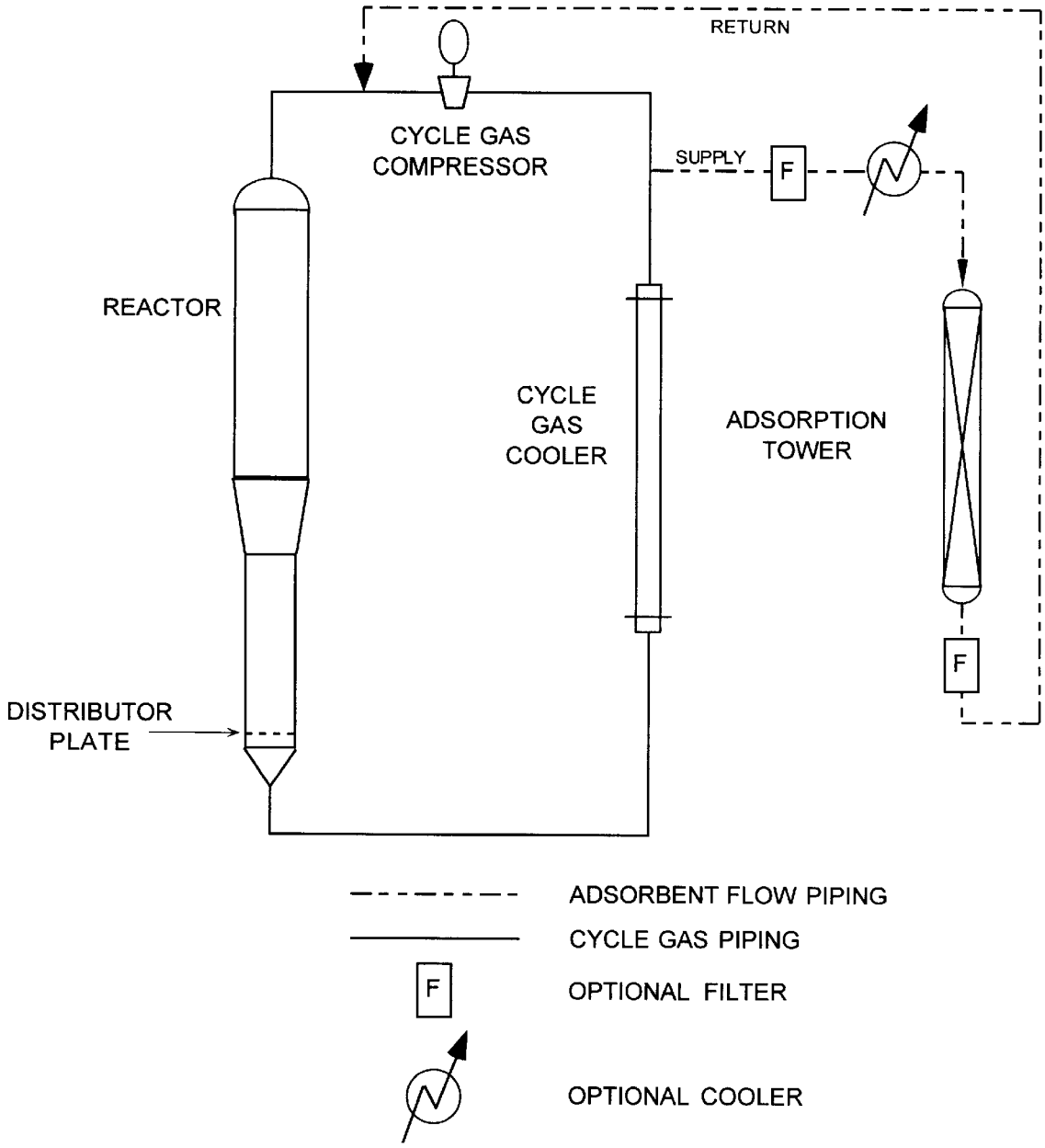

PROCESS FOR DRYING A REACTOR SYSTEM EMPLOYING A FIXED BED ADSORBENT

FIELD OF THE INVENTION

The invention relates to an improved process for drying a reactor system. More particularly, the invention relates to a process for reducing the purge gas consumption and dry-down time required for start-up and operation of a gas phase fluidized bed polymerization system by contacting a cycle gas stream containing moisture and/or a polar hydrocarbon compound with an adsorbing material.

BACKGROUND OF THE INVENTION

Moisture or water and certain other polar hydrocarbon compounds are known poisons for catalysts employed in polymerization processes. For a catalyst to effect polymerization, moisture (or water) and certain other polar hydrocarbon compounds need to be reduced to low levels, typically, less than 20 ppmv, preferably about 1 to 5 ppmv, prior to commencing polymerization. Even low levels of moisture or certain other polar compounds can contribute to static electricity, which in turn can result in fused polymer sheet and skin formations, sometimes causing the reactor to be shut down. For these reasons, it is necessary to provide effective ways of drying the reaction system, or removing polar compounds, such as before startup, during an upset, and after an emergency shutdown in which moisture or other polar compounds may have entered the system.

Commercially, two methods are routinely employed to dry a reaction system—pressure purging or flow purging using a dry gas, hereby referred to as purge gas. The purge gas can include, but is not limited to, air, light hydrocarbons (alkanes having 1–8 carbon atoms, e.g. methane, ethane, butane, isopentane, and the like, especially mixtures thereof), or nitrogen as the drying medium. Preferably the purge gas is nitrogen. During pressure purging, the reaction system is pressured to a high pressure, typically 140 to 180 psig. This is followed by venting to near atmospheric pressure, typically 5 to 10 psig, while maintaining hot (75 to 125 degrees C) recycle gas flow. The system continues in this manner until moisture and/or other contaminants reach the desired low level. Usually, pressure purging is performed before charging a seed bed of polymer to the reactor and after the seed bed is charged to the reactor. Before charging a seed bed to the reactor, the reaction system is dried to a pre-determined ppmv level of water. Once the seed bed is charged, the system is further dried to the same or a lower level of moisture and/or contaminant content.

Flow purging is similar to pressure purging or cycling, except that the pressure is held constant, for example, at about 10 to 20 psig, and a once through flow of about 0.1 fps of dry gas is typically maintained.

In either case, the dry-down time can take hours to several days, often more than one day. The total purge gas consumption is generally greater in approximate proportion to the dry-down time required for conventional purging. Thus, there is a need to reduce the purge gas consumption and reactor downtime required for removal of moisture or other polar hydrocarbon compounds to low ppmv levels, thereby providing a more cost-effective operation.

BRIEF DESCRIPTION OF THE DRAWING

FIG. 1 is a simplified flow diagram of a fluidized bed polymerization system with adsorption tower for drying.

SUMMARY OF THE INVENTION

The present invention provides an improved method of reducing the purge gas consumption, dry down time, or both in a gas phase fluidized bed reactor system, which method comprises contacting a stream of cycle gas having at least 1 ppmv of water, a polar hydrocarbon, or both with an adsorbing material while the cycle gas is in a closed circulation loop.

DETAILED DESCRIPTION OF THE INVENTION

Adsorption Material.

Adsorbents employed can be molecular sieve adsorbents. They can be any crystalline microporous solid having an open framework structure of tetrahedral metal oxides, particularly $PO_2$, $AlO_2$ and $SiO_2$ tetrahedra, uniform pores having nominal diameters large enough to permit passage of water molecules and a capacity for selectively adsorbing water under the imposed conditions in an amount of at least 4 weight percent. These molecular sieves include the well-known zeolite molecular sieve which is composed essentially of $AlO_2$ and $SiO_2$ tetrahedra, and also more recently discovered aluminophosphate molecular sieves in which the crystal framework is composed of $PO_2$ and $AlO_2$ tetrahedra. Other molecular sieve mateial in which other tetrahedral oxide species are substituted for the $PO_2$, $AlO_2$ or $SiO_2$ tetrahedra in the crystal structure are also suitably employed. Of the zeolite molecular sieves, Zeolite A and Zeolite X are particularly employed because of their large capacity for adsorbing water and their relatively low cost. Preferred among these are Type 3A molecular sieves, Type 13X molecular sieves, and activated alumina. Suitable aluminophosphate molecular sieves are disclosed in U.S. Pat. No. 4,310,440. The amount and/or quantity of adsorbent material required is dependent upon, but not limited to, the gas flow, moisture content of the system, and desired moisture removal. These materials can be contained in a vessel, referred to as an adsorption tower or adsorption bed. Alternatively, the adsorbent material can be fed directly into the reaction system and circulated with the cycle gas. Preferably, one or two adsorption towers are employed. It is preferred to use an adsorption tower because, if adsorption material were circulated through the system, operational difficulties may arise during the polymerization process and/or it would be difficult to remove the adsorbent. Also, the collection and regeneration of the adsorbent would be difficult and costly.

Dry-down Process.

The improved method of the invention is illustrated and described by referring to FIG. 1. The method of the invention can be conducted prior to polymerization or during polymerization. Typically, a gas reaction or polymerization system comprises one or more reactors, cycle piping, cycle gas compressor, and cycle gas cooler. The polymerization process itself is known and can be conducted in conventional mode, condensed (including induced condensing mode), or liquid monomer mode. The invention can reduce a typical dry-down time of 12 to 36 hours to a fraction of this time, depending upon the percentage of recycle flow being passed through the adsorption tower. One hundred percent of the cycle flow passing through the adsorption tower typically represents the shortest dry-down time, with lesser amounts increasing the dry-down time. In practice, for 100% cycle flow, more than one volume turnover may be required to allow time for desorption of moisture and polar compounds from equipment or fluidized bed polymer surfaces in the system. If 100% of the cycle flow is employed, representing the shortest dry-down time, then the approximated minimum time is equal to the gas volume of the reaction system (including cycle gas piping, reactor, and cycle gas cooler tubes) divided by the volumetric flowrate through the adsorption tower. Typically in practice, the actual dry-down time is somewhat greater according to the time for desorption of moisture or polar compounds from system surfaces. However, there is an economic trade-off between reducing the dry-down time and the capital investment of an adsorption tower. Accordingly, the economic choice may be to use a percentage of the cycle gas flow, which will increase the dry-down time relative to the minimum time case, but significantly reducing the dry-down time and purge gas consumption relative to conventional purging, and permitting the lower investment cost associated with a smaller adsorption vessel or tower.

In the invention, a stream of cycle gas (containing moisture (or water) or one or more polar hydrocarbon compounds, or a mixture of both), or a portion of the cycle gas stream, is fed to at least one adsorption bed or tower. This stream can be diverted from the reaction system at a location between the cycle gas compressor discharge and the reactor. Preferably, the gas stream is diverted at the point having the lowest gas temperature, because the absorbent bed is more efficient at lower temperatures. Or alternatively, a cooler may be employed to cool the gas slip stream upstream of the adsorbent bed. During the improved dry-down process of the invention, this stream of wet or contaminated cycle gas can have from about 1 to 1500 ppmv of water, polar hydrocarbon compounds, or a mixture thereof. The gas stream going to the tower can comprise from 0.1% to 100%, preferably 1% to 25%, most preferably 1% to 5% of the total cycle gas flow. The flow of the gas through the adsorption tower can be controlled manually such as through the use of a throttling valve. Alternatively, it can be controlled automatically by a conventional flow control loop. Preferably, the flow of gas through the tower is controlled automatically.

The temperature of the wet cycle gas stream can range from about 10 to 110 degrees C, preferably 80 to 110 degrees C, to assist in desorption of water/polar compounds from the inside surfaces of the reaction system. The pressure of wet cycle gas can range from 1 to 1000 psig, preferably 100 to 200 psig. The cycle gas can be air, argon, nitrogen, an alkane (e.g., a $C_1$ to $C_8$ alkane, such as methane, ethane, propane, butane, isopentane, etc.), an alkene (e.g., a $C_2$ to $C_8$ alkene such as ethylene, propylene, butene, etc.), other hydrocarbons, and mixtures thereof. If an alkene is used, the type of adsorbent should be of a type, such as Type 3A, that does not adsorb the alkene material.

Additionally, in another preferred embodiment of the invention the adsorption tower or bed system can be employed in the polymerization of one or more monomers to remove water and/or polar hydrocarbons from the cycle stream during polymerization. This is accomplished by sending at least a portion of the wet or contaminated recycle stream through the adsorption tower loop. Preferably at least one monomer selected from the group consisting of (i) a $C_1$ to $C_{12}$ alpha olefin, (ii) a diolefin, both conjugated and non-conjugated dienes, (iii) a vinyl-aromatic compound, and (iv) mixtures thereof can be employed. This is particularly advantageous when a polymerization process is just commencing to remove small amounts of water and/or polar hydrocarbons (such as carbonyls, alcohols, and sulfides, and mixtures thereof), which can enter the system as a reaction product or from other areas of the reaction system (i.e., from piping, valves, raw material feeds, etc.). It can also be employed throughout a polymerization process to remove any moisture, or any of the above enumerated polar compounds or products that are generated, to ensure that the moisture level or other enumerated polar compound level remains within acceptable limits.

In another preferred embodiment, one or more filters can be added to the adsorption tower system. A first filter is employed on the supply line side of the tower where polymer fines carry-over is filtered from the system. Since these polymer fines could accumulate on the sieves, and subsequently fuse during the regeneration of the tower, it is desired to remove them. A second filter located on the return side of the adsorption tower can be added if there is concern about operational and/or product quality difficulties from accumulation of adsorbent fines in the reaction system.

In a preferred embodiment, the adsorption tower is first dried or activated before use by contacting a heated, dry gas flowing counter flow relative to the flow of the adsorbent cycle gas flow across the bed of adsorbent. For example, if the cycle gas flow during drying of the reaction system is down-flow, then the regeneration flow would be up-flow.

Upon passing the cycle gas or a portion thereof through the adsorption tower, the moisture and/or polar contaminants are adsorbed by the adsorbent material to sub ppmv levels. A detailed description of the operation of the adsorption tower is contained in U.S. Pat. No. 4,484,933. In a dry-down mode, the dry or uncontaminated cycle gas is then recycled back to the closed reaction system where it mixes with the wet and/or contaminated cycle gas. The return flow of the dry cycle gas can re-enter the reaction system anywhere upstream of the compressor. The return flow may enter downstream of the distributor plate of the fluidized bed reactor, but preferably, when using a slip stream, it enters downstream of the reactor and up stream of the cycle gas compressor to take advantage of a higher motive pressure drop to sustain the desired flow through the adsorbent bed and associated equipment. If a partial slip stream of cycle gas is used during the drying process, the drying process closely matches the characteristics of a back mixed system. If the total stream is used, it closely matches the characteristics of a plug flow system.

In the invention, optionally a seed bed can be present in the polymerization reactor. The seed bed can be the same or a different polymer from that which is being polymerized, but is preferably of the same or closely similar polymer. In a preferred embodiment, the polymerization system is dried to a predetermined level such as, for example 50 to 200 ppmv, and then the seed bed is added. After this, the drying is continued until the moisture or polar contaminant content is reduced to 0.5 to 20 ppmv, preferably 1 to 10 ppmv, most preferably 1 to 5 ppmv. When the moisture and/or polar contaminant content is reduced to that level, the polymerization startup can commence. If desired, during the polymerization, a portion of the recycle stream can be sent to the adsorbent tower or adsorbent bed to ensure that moisture and/or contaminants remain at a low level during polymerization so as not to act as a poison to the catalyst, or to adversely affect the product properties.

Generally, molecular sieves such as Type 3A or Type 13X can be regenerated using high temperature (about 300 degrees C and higher) inert gas such as nitrogen, to purge out adsorbed moisture or other polar compounds, to maximize drying capacity of the sieves when returned to service. This is typically accomplished using an electric heater. However, in the present invention, regeneration can be accomplished using medium pressure steam having saturation temperatures ranging from about 185 up to 300 degrees C, typically in the vicinity of about 185 to 250 degrees C. Regeneration using the lower temperature range slightly reduces the adsorbent drying capacity, but more importantly, reduces the personnel and other safety concerns associated with higher surface temperatures, and results in a simpler, lower cost design.

All references cited herein are incorporated by reference.

Whereas the scope of the invention is set forth in the appended claims, the following examples illustrate certain aspects of the present invention. The examples are set forth for illustration and are not to be construed as limitations on the invention, except as set forth in the claims.

EXAMPLES

The following examples are from a pilot scale fluidized bed polymerization system with the following parameters:

| | |
|---|---|
| Reactor Diameter: | 18" (45.7 cm) |
| Cycle Gas Piping Diameter | 3" (7.62 cm) |
| Approximate Cycle Gas Flow: | 3,850 lb/hr (0.48 kg/s) |
| Approximate Cycle Gas Temperature: | 100° C. |
| Approximate Cycle Gas Pressure: | 150 psig (689 kPag) |
| Drying Gas: | Nitrogen |
| Adsorbent: | 3A Molecular Sieve |
| Adsorption Tower Diameter: | 8" (20.3 cm) |
| Approximate Percent Cycle Gas Flow Diverted to Adsorbent Bed: | 30% |

The cycle gas flow supply was between the cycle gas compressor and the cycle gas cooler, while the return was between the cycle gas cooler and the reactor inlet. In addition, a cycle gas control valve was installed in the cycle gas piping between the cycle gas cooler and the reactor inlet, and upstream of the adsorbent flow return. This allowed for additional pressure to overcome the pressure drop through the packed adsorbent. A filter was added to the supply side of the adsorption tower to prevent polymer fines carry-over and the consequent contamination of the adsorption tower.

Example 1

The reactor was pressure purged three times with low pressure nitrogen from around 140 psig to 15 psig, to rid the system of liquid water, similar to the conventional pressure purging method developed commercially. Once this was accomplished, the adsorption tower was placed in service. The time to dry the reaction system from a starting moisture of 635 ppmv water to 57 ppmv water was 3.4 hours. This resulted in an estimated savings of at least 8.6 hours in the dry-down time, and approximately 70% of the nitrogen consumption, as the base line was 12 hours to accomplish this dry-down using the conventional purging technique described above.

Example 2

The reactor was pressure purged three times with low pressure nitrogen to rid the system of liquid water from around 140 psig to 15 psig, similar to the conventional method described above. Once this was accomplished, the adsorption tower was placed in service. The time to dry the reactor from a starting moisture level of 666 ppmv water to 102 ppmv water was 4.0 hours. This resulted in an estimated savings of at least 8.0 hours in the dry-down time and approximately 67% of the nitrogen consumption, as the base line was 12 hours to accomplish this dry-down using conventional pressure purging described above.

Comparative Example A

The reactor was pressure purged with low pressure nitrogen from around 140 psig to 15 psig, similar to the conventional method described above. Multiple purges were required in order to reduce the moisture level to around 50 ppmv. The time necessary to complete these pressure purges was about 12 hours. As Example 2 and 3 above illustrate, the use of an adsorbent bed significantly reduces the drying time and the nitrogen consumption.

Example 3

Use of Adsorbent with a Seed Bed.

The reactor was dried to 57 ppmv water as in Example 1. Once 57 ppmv is reached, the pressure was adjusted to near atmospheric pressure, and a seed bed of 175 lbs of polymer resin was charged to the reactor, while maintaining a nitrogen atmosphere in the reaction system. Once charged, the reactor conditions were established similar to that set forth above. Then, the adsorption tower was placed in service. The system was dried to 10 ppmv, at which time the adsorption tower was isolated from the reaction system, and the reactor was prepared for start-up of the polymerization reaction. By use of the adsorbent bed with a seed bed, the drying time was reduced by approximately 19 to 23 hours depending on temperature and cycle gas flow rate. Nitrogen consumption was also reduced in approximate proportion to the reduction in conventional drying time.

What is claimed is:

1. A method for the continuous polymerization of monomer to produce polymer in a fluidized bed reactor which comprises: preconditioning the reactor by, a) continuously cycling a gaseous stream comprising said monomer through said fluidized bed reactor;

b) continuously or intermittently passing said gaseous stream through an adsorbent bed to thereby reduce the amount of at least one of and, any water and polar compounds present therein to a level below 200 ppmv; thereafter c) dispersing a particulate seed bed into the polymerization zone of said reactor; and thereafter d) continuously or intermittently introducing a suitable catalyst into said polymerization zone while maintaining the temperature within the said polymerization zone below the sintering temperature of said catalyst;

e) continuously or intermittently removing polymer from said reaction zone; and f) continuously adding monomer to said gaseous stream to replace monomer which becomes polymerized and is removed as polymer.

2. The method of claim 1 wherein the adsorbing material is a molecular sieve adsorbent.

3. The method of claim 2 wherein the molecular seive adsorbent is a crystalline microporous solid having (i) an open framework structure of tetrahedral metal oxides, (ii) uniform pores having diameters large enough to permit passage of water molecules.

4. The method of claim 3 wherein the molecular sieve is a zeolite molecular sieve in which the crystal framework is composed of $PO_2$, $AlO_2$, $SiO_2$ tetrahedral oxides, and mixtures thereof.

5. The method of claim 4 wherein the zeolite molecular sieve is selected from the group consisting of Zeolite A, Zeolite X, and mixtures thereof.

6. The method of claim 5 wherein the zeolite molecular sieve is a Type 3A molecular sieve, Type 13X molecular sieve, and activated alumina.

7. The method of claim 6 wherein the zeolite molecular sieve is an aluminophosphate molecular sieve.

8. The method of claim 1 wherein the cycle stream is maintained at a temperature ranging from about 10 to 110 degrees C and a pressure ranging from about 1 to 1000 psig.

9. The method of clam 1 wherein the polar hydrocarbon is selected from the group consisting of a carbonyl, an alcohol, a sulfide, and mixtures thereof.

10. A method according to claim 1 wherein the amount of water and/or polar compounds in said gaseous stream is reduced to a level below 20 ppmv before introducing catalyst into said polymerization zone.

11. A method according to claim 1 wherein the amount of water and/or polar compounds in said gaseous stream is reduced to a level below 10 ppmv before introducing catalyst into said polymerization zone.

12. A method according to claim 1 wherein the amount of water and/or polar compounds in said gaseous stream is reduced to a level below 5 ppmv before introducing catalyst into said polymerization zone.

13. A method according to claim 1 wherein a portion or all of said gaseous stream is continued to be passed through said adsorbent bed to maintain the amount of water and/or polar compounds present in said gaseous stream at or below a predetermined level after commencing to introduce catalyst into said polymerization zone.

14. A method according to claim 1 wherein the temperature within said polymerization zone is maintained at the desired level by passing all or a portion of said gaseous stream through one or more heat exchanger devices.

15. A method according to claim 1 wherein the temperature within said polymerization zone is maintained at the desired level by passing all or a portion of said gaseous stream through one or more heat exchanger devices and all or a portion of said gaseous stream is diverted into said adsorbent bed after passage through one or more of said heat exchangers and before re-entering said reactor.

* * * * *